US008245554B2

(12) United States Patent
Thonig et al.

(10) Patent No.: US 8,245,554 B2
(45) Date of Patent: Aug. 21, 2012

(54) ARRANGEMENT FOR PROCESSING SHEET METAL

(75) Inventors: Harry Thonig, Neukirch (DE); Klaus Vogel, Kirschau (DE); Norbert Gruhl, Hochkirch (DE); Michael Haecker, Wimsheim (DE); Wolf Klaiber, Ditzingen (DE); Eberhard Wahl, Weilheim (DE); Utz Schorn, Stuttgart (DE); Martin Petera, Sindelfingen (DE); Karel Vincke, Oedelem (BE)

(73) Assignees: TRUMPF Sachsen GmbH, Neukirch (DE); TRUMPF Werkzeugmaschinen GmbH + Co. KG, Ditzingen (DE)

( * ) Notice: Subject to any disclaimer, the term of this patent is extended or adjusted under 35 U.S.C. 154(b) by 966 days.

(21) Appl. No.: 12/253,752

(22) Filed: Oct. 17, 2008

(65) Prior Publication Data

US 2009/0107206 A1 Apr. 30, 2009

(30) Foreign Application Priority Data

Oct. 20, 2007 (EP) ..... 07020571

(51) Int. Cl.
*B21D 31/00* (2006.01)

(52) U.S. Cl. ..... 72/362; 72/405.02; 72/405.07

(58) Field of Classification Search ..... 72/405.01, 72/405.02, 405.05, 405.07, 362; 219/121.82; 359/212; 29/563, 564; 228/47.1, 49.1, 49.4
See application file for complete search history.

(56) References Cited

U.S. PATENT DOCUMENTS

| | | | | |
|---|---|---|---|---|
| 3,315,778 | A * | 4/1967 | Kendall, Jr. | 198/465.2 |
| 4,485,911 | A * | 12/1984 | Cameron | 198/345.3 |
| 4,576,099 | A * | 3/1986 | Makino et al. | 104/287 |
| 4,710,122 | A * | 12/1987 | Villanueva | 425/259 |
| 4,972,937 | A * | 11/1990 | Aarts | 198/465.2 |
| 5,412,863 | A * | 5/1995 | Prodel | 29/799 |
| 6,140,606 | A | 10/2000 | Heikilla et al. | |
| 2003/0179430 | A1 | 9/2003 | Kurosawa | |
| 2008/0087651 | A1 | 4/2008 | Pluss | |

FOREIGN PATENT DOCUMENTS

| | | |
|---|---|---|
| EP | 1683601 | 7/2006 |
| JP | 175015 | 5/1989 |
| JP | 4289038 | 10/1992 |
| JP | 2001150070 A | 6/2001 |
| JP | 2003506289 A | 2/2003 |

OTHER PUBLICATIONS

European Search Report from corresponding European Patent Application No. EP 07 02 0571, mailed Jul. 14, 2008, 5 pages. Office Action from corresponding Chinese Application No. 200810190815.5, with translation, mailed May 24, 2010, 12 pages.
Translation of Notification of Reasons for Refusal for corresponding Japanese Application No. 2008-269009, issued Jan. 20, 2012, 4 pages.

* cited by examiner

*Primary Examiner* — Mark Rosenbaum
(74) *Attorney, Agent, or Firm* — Fish & Richardson P.C.

(57) ABSTRACT

A mechanical arrangement for processing sheet metal includes a sheet metal processing device, a transport device configured to position a sheet metal workpiece relative to the sheet metal processing device, the transport device including at least one workpiece carrier that is movable along a transport path that extends along a first transport line and a second transport line, and at least two X-guides and at least two Y-guides, the X-guides arranged parallel with the first transport line and the Y-guides arranged parallel with the second transport line. The at least two X-guides and the at least two Y-guides are configured to be coupled to each other by a transfer device to form a transport course, the workpiece carrier circulates along the X-guides and the Y-guides, and the transfer device is configured to move the workpiece carrier from one of the X-guides to one of the Y-guides.

24 Claims, 5 Drawing Sheets

ARRANGEMENT FOR PROCESSING SHEET METAL

CROSS-REFERENCE TO RELATED APPLICATION

This application claims priority under 35 U.S.C. §119(a) to European Application No. 07 020 571.1, filed on Oct. 20, 2007, the entire contents of which are hereby incorporated by reference.

TECHNICAL FIELD

This disclosure relates to a mechanical arrangement for processing sheet metal. The arrangement includes a sheet metal processing device and a transport device for positioning sheet metal workpieces relative to the sheet metal processing device.

BACKGROUND

Transport devices for positioning sheet metal workpieces relative to sheet metal processing devices can be used, for example, for the automated conveying of the sheet metal workpieces into and out of a working region of sheet metal processing devices. Sheet metal processing devices can include, for example, laser cutting devices for laser-cutting of unprocessed metal plates or punching devices for punching shaped components from unprocessed metal plates.

The transport device conveys unprocessed metal plates to be processed from a loading position to the working region of the sheet metal processing device, positions the unprocessed metal plates in accordance with technical provisions in a processing position inside the working region and conveys, in an unloading operation, the products of the sheet metal processing operation out of the working region of the sheet metal processing device into an unloading position. The products of the sheet metal processing operation can be, for example, finished components and/or processing remnants. The transport device conveys the horizontally supported sheet metal workpieces in a substantially rectilinear manner along a horizontal transport line. As a result, the mechanical arrangement for processing the sheet metal takes up a large amount of space, particularly when the loading and unloading position of the sheet metal workpieces is arranged outside the working region of the sheet metal processing device and particularly for large unprocessed metal plates.

In some known mechanical arrangements with a space-saving transport concept, the sheet metal workpieces are conveyed to the working region of a sheet metal processing device along a transport line in a supported state on transport pallets and, after the processing operation, are conveyed in the reverse direction along the same transport line. The loading position of the unprocessed sheet metal workpiece and the unloading position of the processing product(s) are in this case arranged one above the other at one and the same side of the sheet metal processing device. In such arrangements, a vertically adjustable pallet changing device alternately provides a receptacle for a pallet with the unprocessed sheet metal to be processed (loading position) or for a pallet with the processed product (unloading position). The transport path that is occupied in an alternating direction allows serial changing of the pallets out of or into the working region of the processing device. This can require a substantial changing time, which can result in a high proportion of idle time. Additionally, in the logistical sequence, unprocessed metal sheets have processed products traveling above them, which may bring about contamination of the unprocessed metal sheets.

SUMMARY

In one general implementation, a mechanical arrangement for processing sheet metal includes a sheet metal processing device, a transport device configured to position a sheet metal workpiece relative to the sheet metal processing device, the transport device including at least one workpiece carrier that is movable along a transport path that extends along a first transport line and a second transport line, and at least two X-guides and at least two Y-guides, the X-guides arranged parallel with the first transport line and the Y-guides arranged parallel with the second transport line. The at least two X-guides and the at least two Y-guides are configured to be coupled to each other by a transfer device to form a transport course, the workpiece carrier circulates along the X-guides and the Y-guides, and the transfer device is configured to move the workpiece carrier from one of the X-guides to one of the Y-guides.

Implementations can include one or more of the following features. The transport device can include a transporter for the workpiece carrier, and the transporter can be configured to be loaded with the workpiece carrier while the workpiece carrier moves along the transport path. The transporter can move along the transport path together with the workpiece carrier after being loaded. The transport device can include a transporter loaded with the workpiece carrier, and the workpiece carrier can be configured to be unloaded from the transporter while the workpiece carrier moves along the transport path. The transport course can include at least one guide portion on the transporter. A guide portion of the transport course provided on the transporter can be structurally identical to a portion of the remainder of the transport course. The transport course can be at least partially formed by a guide for the transporter. The transport course can include at least two guides on the transporter, and the at least two guides on the transporter can be displaced relative to each other in a vertical direction. The workpiece carrier can be configured to be associated with an X-guide or a Y-guide of the transport course, and the transporter can be configured to be loaded or unloaded with the workpiece carrier.

In some implementations, one or more of the workpiece carrier and the transporter can be coupled to a bearing, and the bearing can be configured to move the workpiece carrier or the transporter on an X-guide or a Y-guide of the transport course. The bearing can be a roller. One or more of the workpiece carrier and the transporter can have an X-bearing that is associated with an X-guide and a Y-bearing that is associated with a Y guide. Each of the at least two X-guides and the Y-guides can include a rail pair. The mechanical arrangement also can include rollers configured to support one or more of the workpiece carrier and the transporter on the X-guides or the Y-guides, the rollers forming a roller pair that is arranged in a row in a direction parallel to the second transport line. The transfer device can be a lifting device configured to vertically adjust the X-guides and the Y-guides relative to each other. The transfer device can be a pivot device configured to pivot the X-guides and the Y-guides relative to each other. The X-guides and the Y-guides are arranged at different heights, and guide segments of the X-guides or guide segments of the Y-guides can be vertically adjustable by the lifting device. Guide segments of the X-guides or guide segments of the Y-guides are configured to be pivoted by the pivot device.

A drive mechanism can be coupled to the workpiece carrier and can be associated with one of the X-guides or one of the Y-guides. The drive mechanism can be a chain drive. The transporter can include a motorized drive. The transfer device can be configured to be driven selectively. The transfer device can be configured to be driven electrically, pneumatically or hydraulically. A plurality of sheet metal processing devices can be arranged along the first and second transport lines.

In another general implementation, a workpiece is introduced into a sheet metal processing device. The sheet metal processing device is located along a closed transport course formed by at least two X-guides and at least two Y-guides that are configured to be coupled to each other by a transfer device. The workpiece is loaded onto a workpiece carrier, and the workpiece carrier is moved along one of the X-guides, the X-guide is coupled to an adjacent Y-guide with the transfer device. The workpiece carrier is transferred from the X-guide to a Y-guide such that the workpiece carrier and the workpiece circulate about the closed transport course and the workpiece carrier supports the workpiece while the workpiece carrier and the workpiece circulate about the closed transport course.

Implementations can include one or more of the following features. The transfer device can be a pivot device configured to pivot the X-guides and the Y-guides relative to each other. The transfer device can be a lifting device configured to vertically adjust the X-guides and the Y-guides relative to each other.

In another general implementation, a mechanical arrangement for processing sheet metal that allows improved workpiece logistics with a relatively low level of technical complexity is discussed.

In one general implementation, a transport device for positioning sheet metal workpieces relative to a sheet metal processing device is provided and has, for supporting at least one sheet metal workpiece, at least one workpiece carrier that can be moved along a transport path that extends both along the first transport line X and along the second transport line Y.

Various transport mechanisms are included in some of the previously known transport devices for transporting sheet metal workpieces along different transport lines. In some of the previously known devices, the change in direction of the movement of the sheet metal workpieces is carried out by transferring the sheet metal workpieces themselves from one transport mechanism to another. This can involve a complex and large overall construction of the previously known mechanical arrangements. Imprecise positioning of the sheet metal workpieces can occur as a result of transferring the sheet metal workpieces from one transport mechanism to another. Such imprecise positioning can have a disadvantageous effect on the processing and transport of workpieces.

However, as disclosed below, the workpiece carrier supports the sheet metal workpieces during the entire material flow along the transport lines that extend at an angle relative to each other. In the techniques discussed below, the transport paths of unprocessed and processed sheet metal workpieces are not arranged one above the other. In particular, an almost exact association of the sheet metal workpieces relative to the sheet metal processing device is ensured. Technical complexities for additional repositioning of the sheet metal workpieces themselves and the risks of malfunctions which are associated with transferring workpieces from one transport mechanism to another can be prevented.

In one general implementation, there is provided, for the workpiece carrier along its transport path, a transport course that has both at least two guides (X guides) that are arranged parallel with the transport line X and at least two guides (Y guides) that are arranged parallel with the transport line Y, with the workpiece carrier being movable between the X guides and the Y guides by way of transfer devices. The workpiece carrier that is guided in this manner constantly has, even with transport lines that extend at an angle relative to each other, a spatially precisely defined position. Consequently, the spatial arrangement of the sheet metal workpieces that are deposited on the workpiece carrier is also fixed at each point of the transport path and can be reproduced. The high level of positioning accuracy obtained for the sheet metal workpieces at each point of their transport path allows functionally reliable integration of additional devices, for example, additional sheet metal processing devices and handling components. The at least two X guides and the at least two Y guides are arranged and are connected to each other by the transfer devices in such a manner that the workpiece carrier can be moved so as to circulate along the X and Y guides. In this manner, a closed transport course is formed, along which one or more workpiece carriers can move in a circuit and can be positioned at various stations.

The workpiece carriers can pass in a staggered manner through various process stations that are arranged along the transport lines X, Y and can be conveyed back along a short path. For example, the circuit may include, in succession, starting from a work station at which a metal sheet on the workpiece carrier is processed, an unloading station at which the products to be processed are taken from the workpiece carrier and a loading station at which the workpiece carrier is loaded with an unprocessed metal sheet again, before the loaded workpiece carrier is again conveyed along the circulating transport course into the work station. If a plurality of workpiece carriers are used in series, a station can immediately be occupied by a subsequent workpiece carrier after a workpiece carrier has moved out of the station. The sequence can be carried out in this manner without any substantial idle times. This results in acceleration of the material flow, which in turn can bring about a high level of utilization of the processing device of the mechanical arrangement. By extending or branching the guides, there can be associated with the circulating transport course additional sheet metal processing devices such as, for example, laser identification devices, but also additional handling components such as, for example, sorting devices, labeling devices or maintenance and control devices for the workpiece carrier, in particular for inspection and cleaning of the workpiece carrier, in a variable arrangement. A modular construction of the overall arrangement allows flexible adaptation to user-specific assembly circumstances and individual process sequences.

The material flow according to the disclosed techniques can provide space-saving solutions for the mechanical sheet metal processing with a low level of technical complexity.

For example, if a plurality of workpiece carriers are provided along the transport path, work operations, such as, for example, the processing of sheet metal workpieces in the working region of the sheet metal processing device and loading and unloading of sheet metal workpieces by handling components outside the working region, can be configured in parallel. Consequently, down-times of the sheet metal processing device can also be reduced, as well as the overall duration of loading and unloading operations.

In some implementations, the transport device of the arrangement can include a transporter for the workpiece carrier that can be loaded with the workpiece carrier while the workpiece carrier moves along the transport path, and the transporter for the workpiece carrier can be moved along its transport path together with the workpiece carrier after the loading operation. Additionally or alternatively, the workpiece carrier can be unloaded from the transporter along its transport path. Such a construction can allow, with a particularly low level of complexity, a flexible configuration of the transport path of the workpiece carriers which are loaded with sheet metal components. A material flow with a high level of precision being maintained in terms of workpiece positioning is also ensured in this instance. The movement direction of a workpiece carrier can be changed without the sheet metal workpiece which is supported on the workpiece carrier having to be repositioned. In particular, it is possible to move the workpiece carrier, when the transporter is being loaded, in the direction of one of the two transport lines and the transporter which is loaded with the workpiece carrier in the direction of the other transport line. In this case, the transporter constitutes the link between the first and the second transport line and ensures a material flow with a high level of guiding precision.

In some implementations, if the transport course of the workpiece carrier is provided with at least one guide portion on the transporter, the transporter can, without any interruption of a uniform movement of the workpiece carrier, be loaded with the workpiece carrier and have the workpiece carrier unloaded. Naturally, in this implementation, the guide portion of the transport course provided on the transporter is positioned adequately with respect to the remainder of the transport course.

In some implementations, a precisely guided and uniform loading and/or unloading movement of the workpiece carrier can be achieved if, a guide portion of the transport course provided on the transporter for the workpiece carrier is structurally identical to a guide portion of the remainder of the transport course which is adjacent to that guide portion.

In some implementations, a guide for the transporter can constitute a portion of the guide course for the workpiece carrier.

In another implementation, the guide portion provided for the workpiece carrier on the transporter and the guide for the transporter are displaced relative to each other in a vertical direction. For example, the guide portion for the workpiece carrier can be arranged at the level of a working plane that is defined in the working region of a sheet metal processing device, while the guide for the transporter is at the level of the assembly face of the sheet metal processing device. In a corresponding configuration, the transporter can travel over articles that are arranged near the ground. This allows, for example, stacks of unprocessed sheet metal to be stored in a space-saving manner along the X guide or the Y guide. This can provide logistical advantages in that extremely short loading and unloading paths result for the metal sheets of the stack of unprocessed sheet metal. If the transporter supports the workpiece carrier to be transported on an impermeable surface, contamination is prevented from falling from the workpiece carrier onto the articles over which the transporter is moving.

In another implementation, the workpiece carrier can be associated with an X guide or a Y guide of the transport course in that the transporter can be loaded with the workpiece carrier or can have the workpiece carrier unloaded.

In some implementations, the workpiece carrier and/or the transporter have bearings, by which the workpiece carrier and/or the transporter can be moved on an X guide or a Y guide of the transport course. Rollers can be used as the bearings. Rollers can ensure particularly low-friction and smooth-running movement of the workpiece carrier and the transporter. As a result, the forces necessary for moving the workpiece carrier and the transporter along the transport course are minimized.

In the interests of uncomplicated and functionally reliable movement of the workpiece carrier or the transporter in various directions, the workpiece carrier and/or the transporter can have X bearings that are associated with an X guide and Y bearings that are associated with a Y guide. The bearings are arranged and orientated in such a manner that only the bearings provided for the respective direction of movement are active during displacement along the X guide or the Y guide.

In some implementations, each of the X and Y guides includes a rail or a pair of rails. A rail or a pair of rails having rails which are arranged parallel with each other can ensure precise guiding of workpiece carriers and, at the same time, can receive heavy loads when workpiece carriers are guided.

In some implementations, if rollers form a roller pair which is arranged in a row in the transport direction, transitions between the X guides and the Y guides can be traveled over in a smooth manner.

In some implementations, the transfer device includes a lifting device, by which an X guide and a Y guide can be vertically adjusted relative to each other. As a result of the lifting movement of a second guide with respect to that guide which supports a workpiece carrier, the workpiece carrier can be lifted off the guide which supports the workpiece carrier and can be taken up by the second guide. On the second guide, the workpiece carrier can subsequently move along the transport line which is predetermined by the second guide.

In another implementation, the transfer device includes, a pivot device, by which an X guide and a Y guide can be pivoted relative to each other. Similarly to the lifting device discussed above, a second guide is pivoted in this instance relative to the guide on which a workpiece carrier is first guided, and the workpiece carrier is thereby separated from the guide supporting it and is taken up by the second guide. The workpiece carrier can then be moved further along the second guide which defines a second transport line. The pivot drive can advantageously be arranged outside the working region of the sheet metal processing device and is therefore protected from damaging influences owing to sheet metal processing operations.

In some implementations, the X guide and the Y guide are arranged at different heights, with guide segments of the X guide or guide segments of the Y guide being vertically adjustable by the lifting device that is provided as the transfer device. The loads to be lifted, and consequently the lifting forces which are to be applied by the lifting device, are reduced owing to the segmented construction, which has a favorable effect on the construction of the lifting device.

Alternatively, guide segments of the X guide or guide segments of the Y guide can be pivoted using the pivot device, which reduces the necessary pivoting forces with respect to pivoting the complete X guide or Y guide.

In some implementations, a drive which has a drive mechanism, such as a chain drive, which is associated with an X guide and/or a Y guide is provided for the workpiece carrier. The individual drives allow selective conveying operation along the various guides or guide portions. Conveying by the chain drive can result in a particularly high level of functional reliability when workpiece carriers are transported. In some implementations, the transporter has a motorized drive that allows the movement of the transporter along the portion of the transport path associated therewith to be controlled and to be adapted precisely to the positioning requirements. To control the driving of the transfer device, selectively actuatable, electrical, pneumatic or hydraulic drives can be used.

Implementations of the described techniques can include hardware, a method or process, a device, an apparatus, or a system. The details of one or more implementations are set forth in the accompanying drawings and the description below. Further features and advantages of the techniques discussed above ensue from the following description of examples, from the figures, and from the claims. The individual features can be put into effect in a variant of the techniques discussed either individually, or in a plurality of any kind of combination.

DETAILED DESCRIPTION

Figure 1:
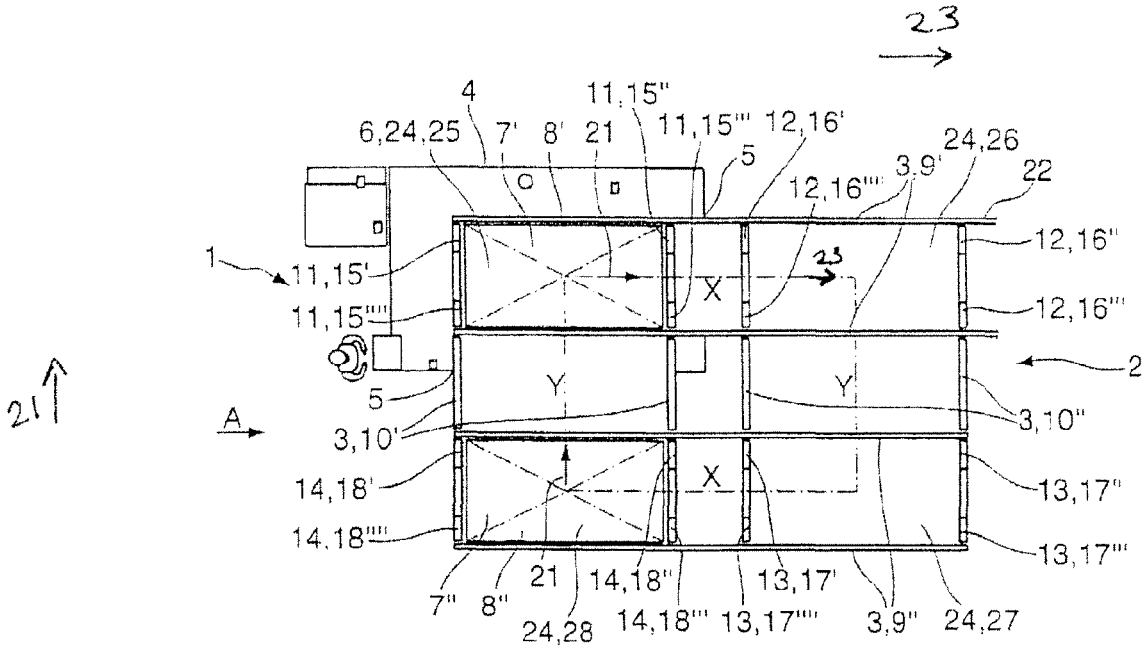
FIG. 1 is a top view of a mechanical arrangement that includes a laser cutting device and a transport device with a circulating transport course, a transfer device, and two displaceable transport pallets in a first station.

Referring to FIG. 1, a mechanical arrangement that includes a sheet metal processing device in the form of a laser cutting machine 1 and having a transport device 2 for loading and unloading the laser cutting machine 1 is illustrated. The transport device 2 includes a transport course 3 that is formed from guide rails. The laser cutting machine 1 is illustrated schematically. A machine frame 4 of the laser cutting machine 1 is shown having a rectangular base that has, at each of two sides, an opening 5 for the passage of the transport course 3. A working region 6 of the laser cutting machine 1 is constructed inside the machine frame 4. The working region 6 includes one or more laser cutting heads (not illustrated) that are arranged in a movable manner for laser-cutting a sheet metal workpiece. The sheet metal workpiece is a sheet metal plate 7' in the example shown in FIG. 1.

A first and a second workpiece carrier, which are rectangular transport pallets 8', 8" in the example shown in FIG. 1, having a planar workpiece support can be displaced along the transport course 3 of the transport device 2 defining a transport path. The sheet metal plate 7' to be processed is arranged on the transport pallet 8'. The transport pallet 8" supports a sheet metal plate 7", which is also to be processed. The transport pallets 8', 8" with the sheet metal plates 7', 7" are each indicated by a rectangle in FIG. 1.

The transport course 3 includes four rectilinear pairs of rails 9', 9", 10', 10" that abut each other in a rectangular manner. The rail pairs 9', 9" extend parallel with transport lines X and accordingly form two X guides. The rail pairs 10', 10" each extend in the form of Y guides parallel with a transport line Y. In the example shown, the transport lines X extend parallel with a longitudinal axis "L" of the laser cutting machine 1, and the transport lines Y extend parallel with a transverse axis "T" of the laser cutting machine 1.

The transport lines X and the transport lines Y enclose an angle of 90° with each other. The rail pairs 9', 9" of the X guides and the rail pairs 10', 10" of the Y guides also form an angle of 90° with each other. The rail pairs 9', 9" of the X guides on the one hand and the rail pairs 10', 10" of the Y guides on the other hand have a different vertical level, with the rail pairs 9', 9" being arranged so as to be slightly lower than the rail pairs 10', 10".

A transfer device is provided in the region of each transition from a rail pair 9', 9" to a rail pair 10', 10". As a result, the transfer of the transport pallets 8', 8" between the rail pairs 9', 9" and the rail pairs 10', 10" is brought about so that the transport pallets 8', 8" can travel over the crossing region of the rail pairs 9', 9", 10', 10". In the example shown in FIG. 1, the transfer devices are in the form of lifting devices 11, 12, 13, 14. Each of the lifting devices 11, 12, 13, 14 includes four vertically adjustable rail segments 15' to 15"", 16' to 16"", 17' to 17"" and 18' to 18"" that are integrated in the rail pairs 10', 10". The operation of the lifting devices 11, 14 is discussed below with respect to FIG. 2.

Figure 2:
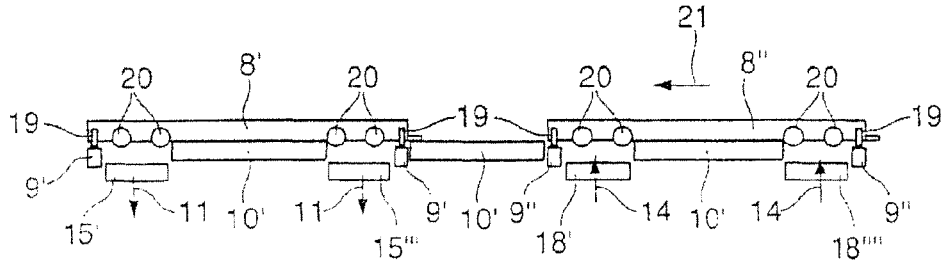
FIG. 2 is a side view of the transport device of FIG. 1.

Referring to FIG. 2, the lifting devices 11 and 14, which are indicated by direction arrows, raise and lower the rail segments 15' to 15"" or the rail segments 18' to 18"". FIG. 2 shows a side view of the transport device of FIG. 1 from the side marked "A" in FIG. 1. The rail pairs 9', 9" of the X guides extend perpendicularly relative to the plane of the drawing. The two transport pallets 8', 8" are located in the crossing regions of the rail pairs 9' and 10' or the rail pairs 9" and 10' visible in FIG. 2. Each of the transport pallets 8', 8" has both roller pairs (X rollers 19) associated with the X guides and roller pairs (Y rollers 20) associated with the Y guides so that the transport pallets 8', 8" can roll on the one hand on the rail pairs 9', 9" of the X guides and on the other hand on the rail pairs 10', 10" of the Y guides.

In order to move the transport pallet 8" transversely along the rail pair 10' of the Y guide illustrated in FIG. 2 in a transport direction 21, the four rail segments 18' to 18"" are simultaneously lifted by the lifting device 14 to the vertical level of the rail pair 10'. The X rollers 19 of the transport pallet 8" are thereby lifted out of the rails of the rail pair 9" of the X guide so that only the Y rollers 20 are supported on the rail pair 10' of the Y guide. When the transport pallet 8" is moved transversely on the higher rail pair 10' of the Y guide, the lower rails of the rail pairs 9', 9" of the X guide are traveled over using the roller pairs 20.

In order to move the transport pallet 8' longitudinally along the rail pair 9' (perpendicularly relative to the plane of the drawing of FIG. 2), the four rail segments 15' to 15"" are lowered by the lifting device 11. The X rollers 19 of the transport pallet 8' thereby come into contact with the rail pair 9', with the Y rollers 20 simultaneously becoming disengaged from the rail segments 15' to 15"". During the longitudinal movement of the transport pallet 8' on the rail pair 9' of the X guide, the lowered rail segments 15' to 15"" allow the rail pair 10' to be able to be passed by the transport pallet 8' in a collision-free manner.

Figure 3:
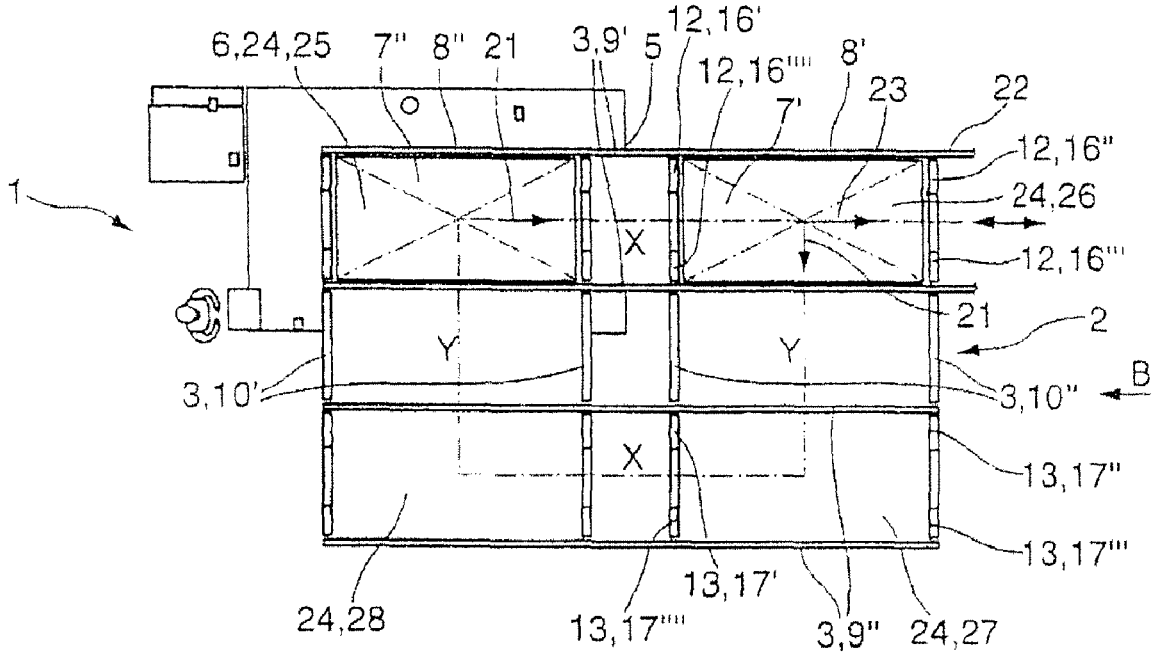
FIG. 3 is a top view of the mechanical arrangement of FIG. 1 with the transport pallets in a second station.

In the manner described, the two transport pallets 8', 8" can be moved along the circulating transport course 3 in a circuit in the clockwise direction (indicated by the arrow 21 in FIG. 1) with cooperation between the lifting devices 11, 12, 13, 14. Similarly, the transport pallets 8', 8" can be moved out of the circuit along a branch 22 of the rail pair 9' of the X guide in the direction of the arrow 23, as indicated in FIGS. 1 and 3. Additionally or alternatively, an additional transport pallet (not illustrated) to be included in the circuit. The circuit of the transport pallets 8', 8" may also be directed in a counter-clockwise manner.

The drive of the transport pallets 8', 8" can be carried out with chain drives (not shown) that include carrier elements of motor-driven conveying chains engaging with carriers of the transport pallets 8', 8". An independent chain drive, each chain drive including a conveying chain, is associated with each rail pair 9', 9" and each rail pair 10', 10".

In each crossing region of the X and Y guides, a process station 24 is provided at which the transport pallets 8', 8" pause in order for specific working operations to be carried out on the workpiece carried by the transport pallets 8','8". One of the crossing regions is in the working region 6 of the laser cutting machine 1, where a cutting station 25 is constructed in order to laser-cut the sheet metal plates. Additional process stations 24 that cab be used, for example, for automatically unloading the transport pallets 8', 8", for automatically loading the transport pallets 8', 8" with unprocessed metal plates 7', 7" and for temporary parking of the transport pallets 8', 8", are provided outside the machine frame 4 of the laser cutting machine 1.

For example, previously cut-out sheet metal parts can be selectively unloaded at an unloading station 26 by an external sorting device (not illustrated), with a remaining skeleton of the processed sheet metal plate 7', 7" remaining on the relevant workpiece carrier. In addition or alternatively, a laser identification device (not illustrated) can also be stationed at the intermediate station described to automatically inscribes the cut sheet metal parts before they are removed from the remaining skeleton.

An example operating sequence of the mechanical arrangement illustrated in FIGS. 1 to 4 is as follows:

In FIG. 1, the transport pallet 8' is in the cutting station 25. The sheet metal plate 7' is being processed. The second transport pallet 8" is arranged at the process station that is used as the loading station 28 and is loaded with a sheet metal plate 7" at the same time as the cutting processing of the sheet metal plate 7'. The loading of the transport pallet 8" may be carried out, for example, by a suction frame of an automatic loading device (not illustrated). A suction frame is a frame-like structure that includes suction cups that are fixed to the underside of the frame-like structure. The suction frame can be used, for example, to load a punching machine with metal sheets to be processed and for transferring processed metal sheets from the punching machine.

After the sheet metal plates 7' have been processed in the cutting station 25, the transport pallet 8' is displaced into the unloading station 26 with longitudinal travel in the direction of the arrow 21. To that end, first the four rail segments 15' to 15"" are lowered by the lifting device 11 together with the transport pallet 8' so that the X rollers 19 of the transport pallet 8' rest on the rail pair 9' of the X guide and the Y rollers 20 become disengaged from the rail pair 10' as shown in FIG. 2. At the same time or immediately afterwards, the rail segments 16' to 16"" at the unloading station 26 are also lowered by the lifting device 12. In order to convey the transport pallet 8' in a longitudinal direction (along the rail pair 9'), carrier elements of the conveying chain which is operated at the rail pair 9' engage in carriers on the transport pallet 8'.

As soon as the transport pallet 8' has left the cutting station 25, the rail segments 15' to 15"" are again raised to the vertical level of the rail pair 10' of the Y guide so that the transport pallet 8" can move out of the loading station 28 into the cutting station 25 in a transverse direction (such as the direction shown by the arrow 21 in FIGS. 1 and 2) along the Y guide with rail segments 18' to 18"" being raised. The Y rollers 20 of the transport pallet 8" each move over a rail of the rail pairs 9" and 9'. The transport pallet 8" is driven by carrier elements of the conveying chain that is operated along the rail pair 10' and engages carriers of the transport pallet 8".

The resulting configuration is shown in FIG. 3. The transport pallet 8' is at the unloading station 26 while the transport pallet 8" with sheet metal plate 7" is stationed at the cutting station 25 in the working region 6 of the laser cutting machine 1. The previously cut finished parts are removed from the remaining skeleton of the sheet metal plate 7' at the unloading station 26 in an automated manner and can also be automatically inscribed.

Figure 4:
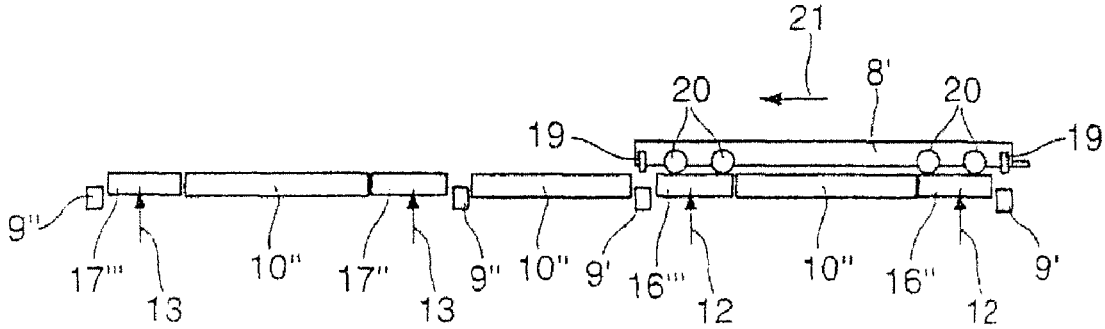
FIG. 4 is a side view of the transport device of FIG. 3.

The further travel of the transport pallets 8', 8" is brought about similarly to the operations discussed above. Referring to FIG. 4, a side view of the mechanical arrangement of FIG. 3 is shown. FIG. 4 shows a side view from the side marked as "B" in FIG. 3. In order to move the transport pallet 8' transversely along the rail pair 10" of the Y guide into the process station 24 that is used as an additional unloading station 27, the rail segments 16' to 16"" and the transport pallet 8' are raised to the vertical level of the rail pair 10" of the Y guide so that the X rollers 19 of the transport pallet 8' are disengaged from the rail pair 9' of the X guide and the transport pallet 8' can travel along the rail pair 10". In this instance, the transport pallet 8' rolls with the Y rollers 20 over a rail of each of the rail pairs 9', 9". Before the unloading station 27 is reached, the rail segments 17' to 17"" are raised by the associated lifting device 13. In order to convey the transport pallet 8', carrier elements of the conveying chain operated along the rail pair 10" engage in carriers on the transport pallet 8'.

If the transport pallet 8' has left the unloading station 26, the rail elements 16' to 16"" are lowered again. This allows longitudinal travel of the transport pallet 8" into the unloading station 26. The remaining skeleton of the sheet metal plate 7' is removed from the transport pallet 8', which has arrived in the meantime at the unloading station 27, by a removal rake of an automated unloading device.

By subsequent longitudinal travel along the rail pair 9", the transport pallet 8' reaches the loading station 28, with the rail segments 17' to 17"" and 18' to 18"" being lowered, where the transport pallet 8' is again loaded with an unprocessed sheet metal plate.

The direct proximity of the unloading station 27 and the loading station 28 along the transport course 3 allows direct and space-saving association of the mechanical arrangement illustrated with a workpiece store. The performance of the whole arrangement, and, in particular the degree of utilization of the laser cutting machine 1, can be further increased if the four process stations 24 are passed through in series along the transport course 3 by an additional transport pallet (not illustrated).

Figure 5:
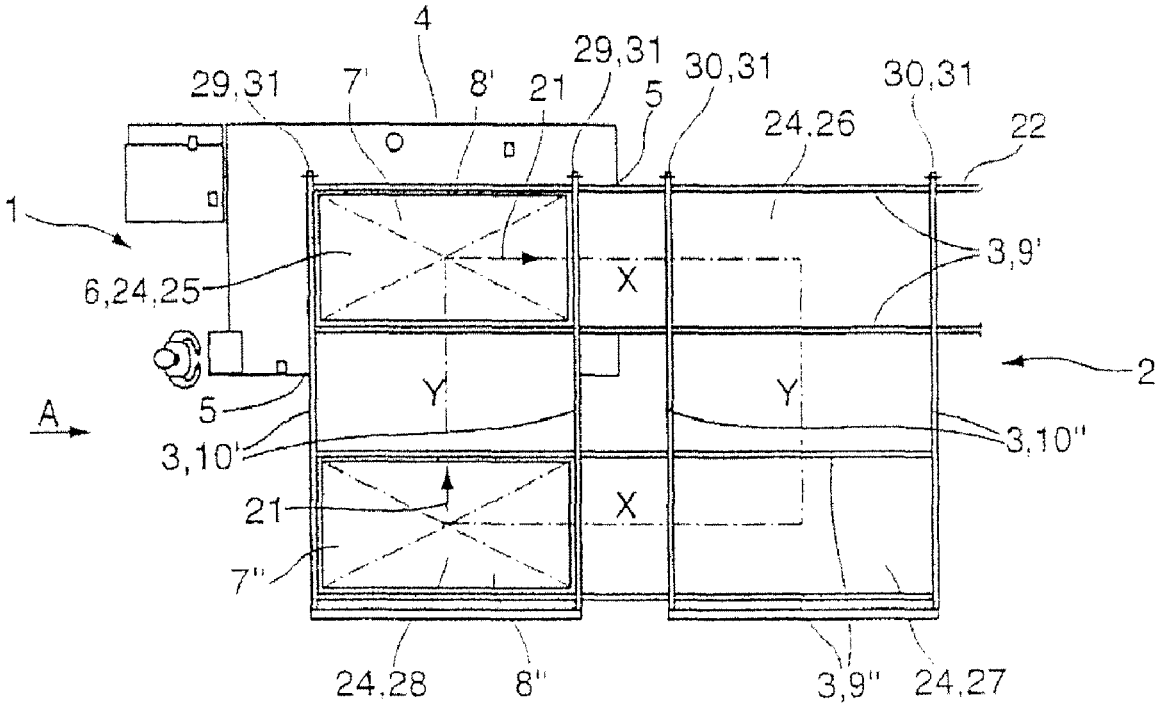
FIG. 5 is a top view of another mechanical arrangement that includes a laser cutting device and a transport device with a circulating transport course, a transfer device, and two displaceable transport pallets in a first station.

Referring to FIG. 5, a top view of another implementation of the mechanical arrangement with a circulating transport course is shown. The transport device 2 of the mechanical arrangement shown in FIGS. 5 to 8 includes a transport course 3, that circulates along a transport path, for transport pallets 8', 8" similarly to FIGS. 1 to 4. The same reference numerals refer to the same components.

The implementation shown in FIGS. 5 to 8 differs from the example shown in FIGS. 1-4 in terms of the construction of the transfer device. As discussed above, in the example of FIGS. 1-4, the lifting devices 11, 12, 13, 14 act as the transfer device. In the example shown in FIGS. 5-8, instead of the four lifting devices 11, 12, 13, 14, two pivot devices 29, 30 by which a complete rail pair 10' and 10" of the Y guides can be pivoted act as transfer devices. The transfer of the transport pallets 8', 8" at two intersection regions of the rail pairs 9', 9", 10', 10" can be brought about with the pivot devices 29, 30.

Figure 6:
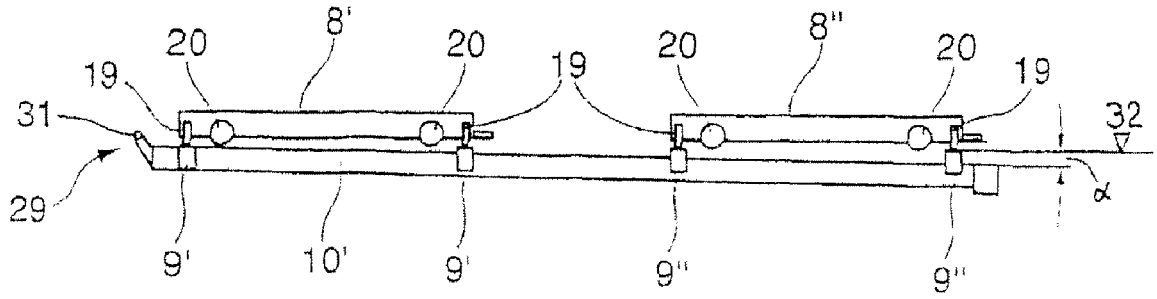
FIG. 6 is a side view of the transport device of FIG. 5 with the transfer device in a first state.
Figure 7:
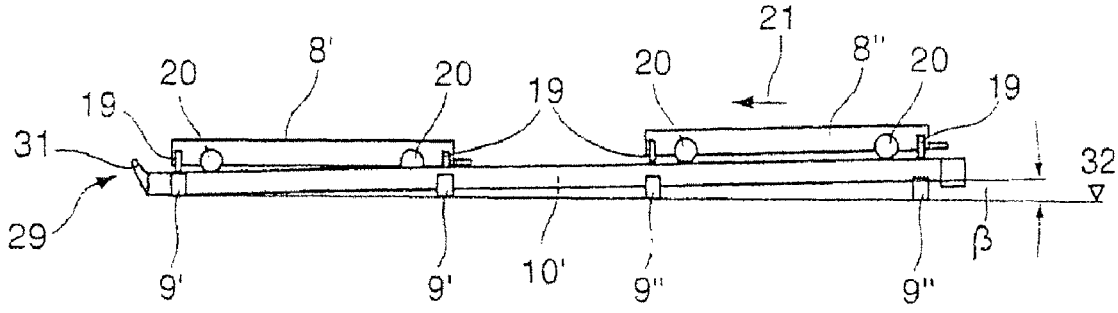
FIG. 7 is a side view of the transport device of FIG. 5 with the transfer device in a second state.

Referring to FIGS. 6 and 7, side views of the transfer devices of FIG. 5 are shown. In particular, FIGS. 6 and 7 are each a side view of a rail of the rail pair 10', and FIGS. 6 and 7 illustrate the operation of the pivot devices 29, 30. In the examples shown in FIGS. 6 and 7, the rail pairs 9', 9" extend perpendicularly to the plane of the drawing.

Referring to FIG. 6, a side view of the transport device of FIG. 5 is shown from the side marked "A" in FIG. 5. the pivot device 29 pivots the rail pair 10' about a pivot axis 31 with a pivot angle α slightly below a horizontal level 32 of the fixed rail pairs 9', 9", and, referring to FIG. 7, the pivot device 29 pivots the rail pair 10' with a pivot angle β slightly above the horizontal level 32 of the fixed rail pairs 9', 9". FIG. 7 shows a side view of the transport device of FIG. 5 from the side marked "A" in FIG. 5. At the same time as the rail pair 10' pivots, the transport pallets 8', 8" on the rail pair 10' are raised or lowered relative to the rail pairs 9', 9" in order to be able to travel over the regions of the crossing of the rail pairs 9', 9" with the rail pair 10'. The pivot axis 31 and also the drives of the pivot devices 29, 30 are located in a protected state outside the process stations 24, in particular outside the working region 6 of the cutting station 25 of the laser cutting machine 1.

An example operating sequence of the arrangement illustrated in FIGS. 5 to 8 is as follows:

In FIG. 6, the transport pallets 8', 8" are located as shown in the arrangement of FIG. 5 in the crossing regions of the rail pairs 9', 9" with the rail pair 10', with both transport pallets 8', 8" each being supported with their X rollers 19 on the rail pairs 9', 9". The pivot device 29 has lowered the rail pair 10' with a pivot angle α of approximately 5° below the height level 32 of the fixed rail pairs 9', 9". In this position of the rail pair 10', first the longitudinal travel of the transport pallet 8' along the rail pair 9' can be carried out in a collision-free manner.

As soon as the transport pallet 8' has moved out of the crossing region, the rail pair 10' is pivoted above the height level 32 of the fixed rail pairs 9', 9" with a pivot angle β by the pivot device 29. The pivot angle β of approximately 5° is sufficient to raise the X rollers 19 of the transport pallet 8" out of the rails of the rail pair 9" so that the transport pallet 8" can move in a collision-free manner over the rail pairs 9', 9" with transverse travel along the rail pair 10'.

In the manner described, first a transport pallet 8' in the cutting station 25 can be moved with longitudinal travel to the subsequent unloading station 26, with the rail pair 10" also being lowered (pivot angle α) into a position below the rail pairs 9', 9" by the second pivot device 30. The transverse travel of the transport pallet 8" out of the loading station 28 into the cutting station 25 is brought about along the rail pair 10' which is lifted above the horizontal height level 32 of the rail pairs 9', 9" again with a pivot angle β.

Figure 8:
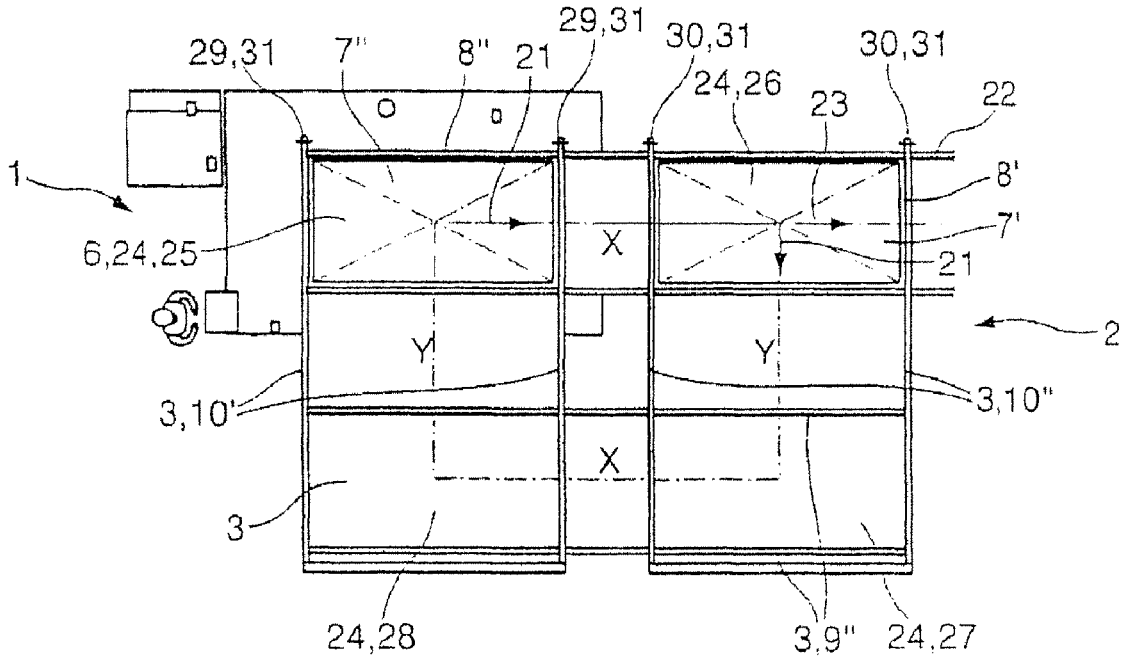
FIG. 8 is a top view of the mechanical arrangement of FIG. 5 with the transport pallets in a second station arrangement.

Referring to FIG. 8, a top view of the transport device 2 of FIG. 5 is shown with advanced stationing of the transport pallets 8', 8". The transport pallet 8' is in the unloading station 26 while the transport pallet 8" is now stationed at the cutting station 25 in the working region 6 of the laser cutting machine 1.

The serial further travel of the transport pallets 8', 8" into the unloading station 27 and subsequently into the loading station 28 is carried out similarly to the above operations using the pivot devices 29, 30 with which the rail pairs 10', 10" are alternately raised and lowered.

Figure 9:
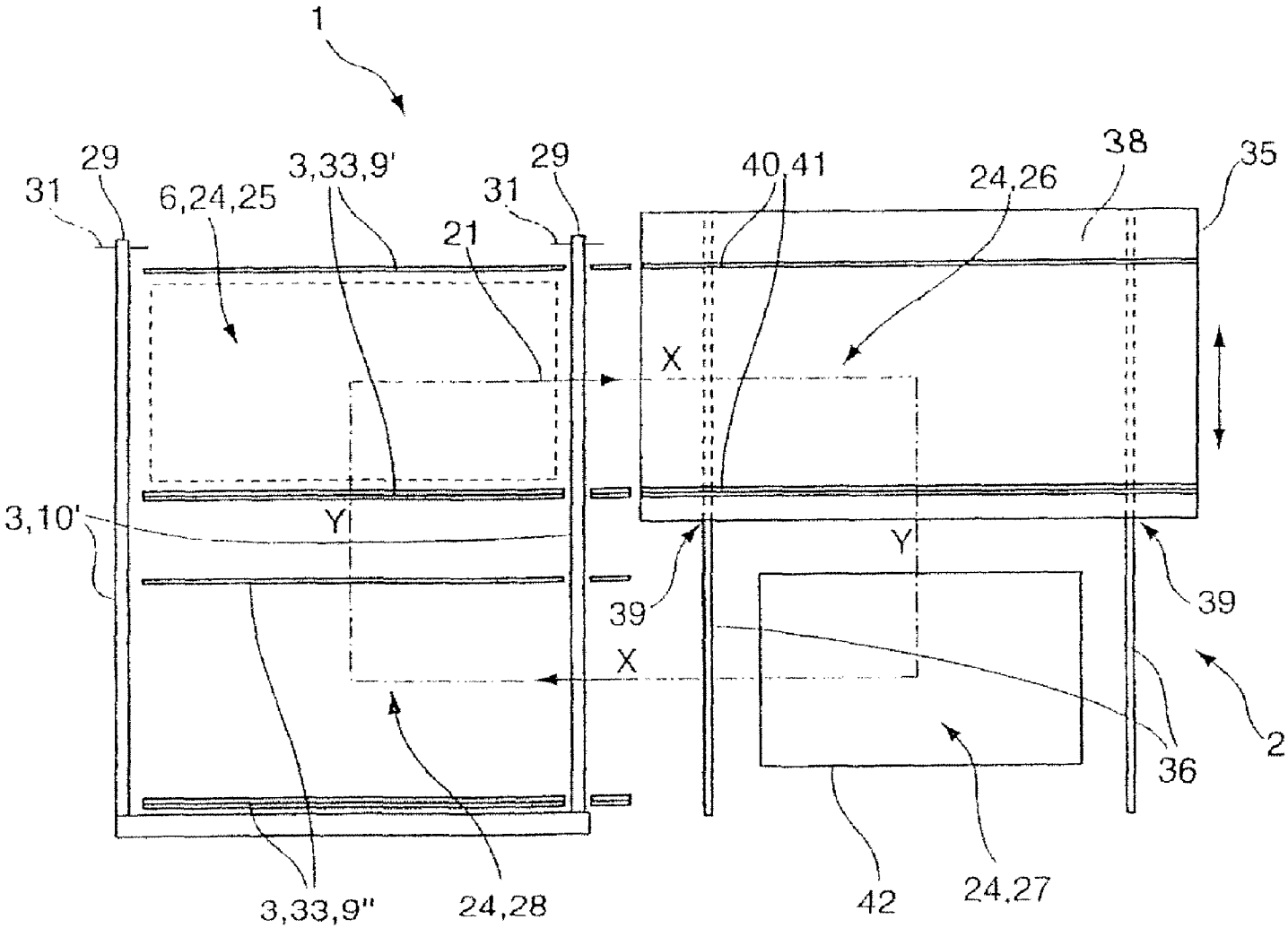
FIG. 9 is a top view of a transport device of a mechanical arrangement that includes a transport carriage.

Referring to FIG. 9, a top view of the transport device 2 is shown. FIG. 9 shows an implementation of the transport device 2 of the laser cutting machine 1 that combines a transport course 3, which extends along a transport path similarly to the examples discussed above with respect to FIGS. 1 and 5, except the example shown in FIG. 9 includes a transporter in the form of a transport carriage 35. The example shown in FIG. 9 shows the working region 6 of the laser cutting machine 1 at the cutting station 25 in a dot-dash manner. The reference numerals used in FIG. 9 refer to the same components that the reference numbers refer to in FIGS. 1-8.

The transport course 3 includes two X guides and two Y guides for the transport pallets 8', 8" (not illustrated). A portion 33 of the X guides is formed by rail pairs 9', 9". A guide portion 40, which is provided on the transport carriage 35 and is in the form of a rail pair 41, acts as an additional portion of the X guides. The rail pair 41 is mounted on the upper side of a table 38 of the transport carriage 35. The rail pair 41 is structurally identical to the rail pairs 9', 9".

In the example shown in FIG. 9, the rail pair 10' and a rail pair 36 are provided as Y guides of the transport course 3. The rail pair 10' can be pivoted relative to the rail pairs 9', 9" in the manner described above in order to transfer the transport pallets 8', 8". While the rail pair 41 is arranged at the upper side of the transport carriage 35 at the same height as the rail pairs 9', 9", the rail pair 36 is mounted at a lower level. In some implementations, the rail pair 36 is mounted directly on the assembly surface of the laser cutting machine 1. The transport carriage 35 rests on the rail pair 36 with foot members 39. Motor-driven rollers act as bearings on the foot members 39 of the transport carriage 35. In this manner, the rail pair 36 acts as a guide for the transport carriage 35 along one of the Y transport lines of the transport pallets 8', 8".

If the transport carriage 35 takes up the position illustrated in FIG. 9, the rail pair 41 on the table 38 of the transport carriage 35 is aligned with the rail pair 9' at the cutting station 25 of the laser cutting machine 1. Consequently, a transport pallet 8' or 8" can be transferred from the cutting station 25 to the transport carriage 35 by longitudinal travel along the upper X guide in FIG. 9. Accordingly, it would be possible to convey a transport pallet 8' or 8" arranged on the transport carriage 35 to the cutting station 25. A chain drive which is arranged along the upper X guide and by which the transport carriage 35 can be loaded with the relevant transport pallet 8', 8", or by which the transport pallet 8', 8" can be unloaded from the transport carriage 35, in each case serves to move the transport pallet 8', 8".

The transport carriage 35 can be moved in a motor-driven manner along the Y guide, which is on the right in FIG. 9. The relevant displacement movement can be carried out as idle travel; alternatively, the transport carriage 35 can be loaded with a transport pallet 8', 8" and can also convey the transport pallet 8', 8" in a piggy-back manner.

An empty space which is produced between the foot portions 39 for logistical purposes is provided at the underside of the table 38, for example, for storing an unprocessed sheet metal stack 42. If the unprocessed sheet metal stack 42 is arranged in the region of the unloading station 27, the unprocessed sheet metal stack 42 is usually freely accessible for supply and removal components when the transport carriage 35 is in the position shown in FIG. 9 (unloading station 26). When the transport carriage 35 is moved into the unloading station 27, the unprocessed sheet metal stack 42 is traveled over by the transport carriage 35 in a collision-free manner. Because the table 38 of the transport carriage 35 forms an impermeable table surface, it is impossible for contamination, such as, for example, slag or other cutting refuse, on the upper side of the transport carriage 35, to reach the stack when the unprocessed sheet metal stack 42 is traveled over.

An example operating sequence of the mechanical arrangement shown in FIG. 9 is as follows:

The transport device 2 discussed and shown above with respect to FIG. 1 also brings about circulating operation of the transport pallets 8', 8". If a transport pallet 8' is at the cutting station 25 of the laser cutting machine 1, the rail pair 10' is lowered by the pivot device 29 after the workpiece processing is finished. Consequently, the transport pallet 8' can move with the cut metal sheet 7' along the rail pair 9' and pass the rail pair 10' in a collision-free manner. As the transport pallet 8' travels out of the working region 6 of the cutting station 25, the transport pallet 8' is pushed by the relevant chain drive onto the guide portion 40 of the transport carriage 35. In the example shown in FIG. 9, the transport carriage 35 is at the unloading station 26.

Subsequently, the cut finished parts are removed from the remaining skeleton of the sheet metal plate 7' in the above-described manner at the unloading station 26. The transport carriage 35 subsequently moves the transport pallet 8' supported by the transport carriage 35 with the remaining skeleton of the sheet metal plate 7' to the unloading station 27 with transverse travel. During that transverse travel, the transport carriage 35 moves along the rail pair 36. The transport carriage 35 with the transport pallet 8' and the remaining skeleton of the sheet metal plate 7' is at the unloading station 27 directly above the unprocessed sheet metal stack 42. The remaining skeleton of the sheet metal plate 7' is now removed from the transport pallet 8' in the manner described above.

If the transport carriage 35 is at the unloading station 27, the rail pair 41 at its upper side is aligned with the rail pair 9". Consequently, the transport pallet 8' can be unloaded from the transport carriage 35 by the relevant chain drive with longitudinal travel and be pulled into the loading station 28. The rail pair 10' is lowered by the pivot device 29.

If the transport pallet 8' has left the transport carriage 35, the carriage is moved back into the unloading station 26 with idle travel in order optionally to be able to take up a subsequent transport pallet 8" from the cutting station 25 at that location. The transport pallet 8' is loaded with unprocessed sheet metal at the loading station 28 during this time. That unprocessed sheet metal is supplied to the transport pallet 8' from the unprocessed sheet metal stack 42 which is arranged directly adjacent to the loading station 28.

Finally, the transport pallet 8' loaded with the unprocessed sheet metal moves with transverse travel out of the loading station 28 into the cutting station 25. The rail pair 10' is raised relative to the rail pairs 9', 9" by the pivot device 29.

In the manner described, the transport pallets 8', 8" move in a circulating manner through the individual process stations 24.

The foregoing description is intended to illustrate and not limit the scope of the techniques discussed above. Other aspects, advantages, and modifications are within the scope of the following claims. For example, although all of the examples discussed above relate to arrangements having four process stations 24 and two circulating transport pallets 8', 8", the disclosed techniques are not restricted thereto. Instead, other numbers and combinations of process stations 24 are also possible. The number of transport pallets in circulation is also individually selectable and is limited only by the number of process stations 24 which can be occupied.

In another example, the transport lines X, Y have, in the examples described above, a rectilinear extent at right-angles to each other. However, other examples can includes moving transport pallets 8', 8" along curved transport lines X, Y and/or arranging the transport lines X, Y relative to each other at an angle other than a right angle.

What is claimed is:

1. A mechanical arrangement for processing sheet metal, the arrangement comprising:

a sheet metal processing device;

a transport device configured to position a sheet metal workpiece relative to the sheet metal processing device, the transport device including at least one workpiece carrier that is movable along a transport path that extends along a first transport line and a second transport line; and at least two X-guides and at least two Y-guides, the X-guides arranged parallel with the first transport line and the Y-guides arranged parallel with the second transport line, wherein the at least two X-guides and the at least two Y-guides are configured to be coupled to each other by a transfer device to form a transport course, the workpiece carrier circulates along the X-guides and the Y-guides, and the transfer device is configured to move the workpiece carrier from one of the X-guides to one of the Y-guides, and wherein the transfer device is a lifting device configured to vertically adjust the one of the X-guides and the one of the Y-guides relative to each other to transfer a workpiece carrier from a position in which the workpiece carrier is supported by the one of the X-guides into a position in which the workpiece carrier is disengaged from the X-guide and taken up by the one of the Y-guides, the workpiece carrier thus being enabled to subsequently move along the Y-guide.

2. The mechanical arrangement of claim 1, wherein the transport device comprises a transporter for the workpiece carrier, and the transporter is configured to be loaded with the workpiece carrier while the workpiece carrier moves along the transport path, and the transporter moves along the transport path together with the workpiece carrier after being loaded.

3. The mechanical arrangement of claim 2, wherein the transport course includes at least one guide portion on the transporter.

4. The mechanical arrangement of claim 3, wherein a guide portion of the transport course provided on the transporter is structurally identical to a portion of the remainder of the transport course.

5. The mechanical arrangement of claim 3, wherein the transport course includes at least two guides on the transporter, and the at least two guides on the transporter are displaced relative to each other in a vertical direction.

6. The mechanical arrangement of claim 2, wherein the transport course is at least partially formed by a guide for the transporter.

7. The mechanical arrangement of claim 2, wherein the workpiece carrier is configured to be associated with an X-guide or a Y-guide of the transport course, and the transporter is configured to be loaded or unloaded with the workpiece carrier.

8. The mechanical arrangement of claim 2, wherein one or more of the workpiece carrier and the transporter are coupled to a bearing, and the bearing is configured to move the workpiece carrier or the transporter on an X-guide or a Y-guide of the transport course.

9. The mechanical arrangement of claim 8, wherein one or more of the workpiece carrier and the transporter have an X-bearing that is associated with an X-guide and a Y-bearing that is associated with a Y guide.

10. The mechanical arrangement of claim 8, wherein the bearing comprises a roller.

11. The mechanical arrangement of claim 2, further comprising rollers configured to support one or more of the workpiece carrier and the transporter on the X-guides or the Y-guides, the rollers forming a roller pair that is arranged in a row in a direction parallel to the second transport line.

12. The mechanical arrangement of claim 2, wherein the transporter comprises a motorized drive.

13. The mechanical arrangement of claim 1, wherein the transport device comprises a transporter loaded with the workpiece carrier, and the workpiece carrier is configured to be unloaded from the transporter while the workpiece carrier moves along the transport path.

14. The mechanical arrangement of claim 1, wherein each of the at least two X-guides and the Y-guides comprises a rail pair.

15. The mechanical arrangement of claim 1, wherein the lifting device is a pivot device configured to pivot the X-guides and the Y-guides relative to each other.

16. The mechanical arrangement of claim 15, wherein guide segments of the X-guides or guide segments of the Y-guides are configured to be pivoted by the pivot device.

17. The mechanical arrangement of claim 1, wherein:

at least one of the X-guides and at least one of the Y-guides are arranged at different heights, and guide segments of at least one of the X-guides or guide segments of at least one of the Y-guides are vertically adjustable by the lifting device.

18. The mechanical arrangement of claim 1 further comprising a drive mechanism coupled to the workpiece carrier and associated with one of the X-guides or one of the Y-guides.

19. The mechanical arrangement of claim 18, wherein the drive mechanism is a chain drive.

20. The mechanical arrangement of claim 1, wherein the transfer device is configured to be driven selectively.

21. The mechanical arrangement of claim 20, wherein the transfer device is configured to be driven electrically, pneumatically or hydraulically.

22. The mechanical arrangement of claim 1, wherein a plurality of sheet metal processing devices are arranged along the first and second transport lines.

23. A method of processing sheet metal, the method comprising:

introducing a workpiece into a sheet metal processing device, the sheet metal processing device being located along a closed transport course formed by at least two X-guides and at least two Y-guides that are configured to be coupled to each other by a transfer device;

loading the workpiece onto a workpiece carrier;

moving the workpiece carrier along one of the X-guides;

coupling the X-guide to an adjacent Y-guide with the transfer device; and transferring the workpiece carrier from the X-guide to a Y-guide such that the workpiece carrier and the workpiece circulate about the closed transport course and the workpiece carrier supports the workpiece while the workpiece carrier and the workpiece circulate about the closed transport course, wherein the transfer device is a lifting device and vertically adjusts the X-guide and the adjacent Y-guide relative to each other thereby transferring the workpiece carrier from a position in which the workpiece carrier is supported by the X-guide into a position in which the workpiece carrier is disengaged from the X-guide and taken up by the adjacent Y-guide, the workpiece carrier thus being enabled to subsequently move along the adjacent Y-guide.

24. The method of claim 23, wherein the lifting device is a pivot device configured to pivot the X-guides and the Y-guides relative to each other.

* * * * *